United States Patent [19]

Honda et al.

[11] Patent Number: 4,763,617

[45] Date of Patent: Aug. 16, 1988

[54] SEALED-TYPE HYDRAULIC LASH ADJUSTER

[75] Inventors: Shoichi Honda, Tokyo; Masayasu Sakata; Yoichi Ishida, both of Saitama, all of Japan

[73] Assignee: Honda Giken Kogyo Kabushiki Kaisha, Tokyo, Japan

[21] Appl. No.: 942,337

[22] Filed: Dec. 16, 1986

[30] Foreign Application Priority Data

Dec. 17, 1985 [JP] Japan ..... 60-283642

[51] Int. Cl.[4] ..... F01L 1/24

[52] U.S. Cl. ..... 123/90.58; 123/90.33; 123/90.43

[58] Field of Search ..... 123/90.58, 90.33, 90.43, 123/90.59

[56] References Cited

U.S. PATENT DOCUMENTS

| | | | |
|---|---|---|---|
| 2,757,653 | 8/1956 | Links et al. | 123/90.43 |
| 2,833,257 | 8/1958 | Lengnick | 123/90.44 |
| 2,871,839 | 2/1959 | Mekkes | 123/90.43 |
| 2,925,074 | 2/1960 | Dadd | 123/90.59 |
| 2,971,502 | 2/1961 | Wride | 123/90.59 |
| 4,338,894 | 7/1982 | Kodama | 123/90.43 |
| 4,359,018 | 11/1982 | Wade | 123/90.33 |
| 4,457,270 | 7/1984 | Kodama et al. | 123/90.58 |
| 4,491,098 | 1/1985 | Rotondo | 123/90.58 |
| 4,694,790 | 9/1987 | Kowal | 123/90.58 |

*Primary Examiner*—Willis R. Wolfe, Jr.
*Assistant Examiner*—M. Macy
*Attorney, Agent, or Firm*—Lyon & Lyon

[57] ABSTRACT

A sealed-type hydraulic lash adjuster having a reservoir chamber holding a hydraulic oil having a molecular weight distribution substantially equal to the molecular weight distribution of the exterior oil surrounding the lash adjuster. The approximate matching of molecular weight distributions of the hydraulic oil within the lash adjuster, and the exterior oil contacting the outside of the lash adjuster ensures that the volume of oil in the reservoir chamber remains substantially constant, as the amount of hydraulic oil passing through the diaphragm of the lash adjuster from the reservoir is equal to the amount of exterior oil passing through the diaphragm into the reservoir chamber.

6 Claims, 4 Drawing Sheets

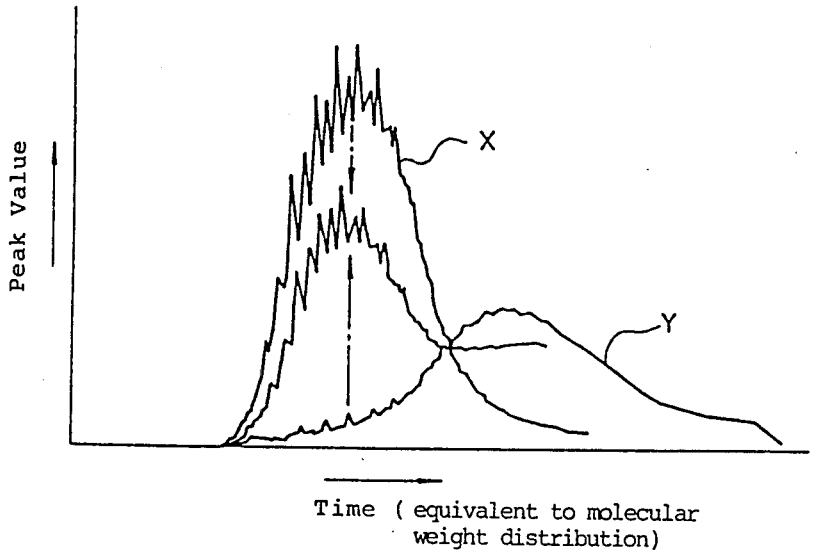
FIG. 1.
FIG. 2
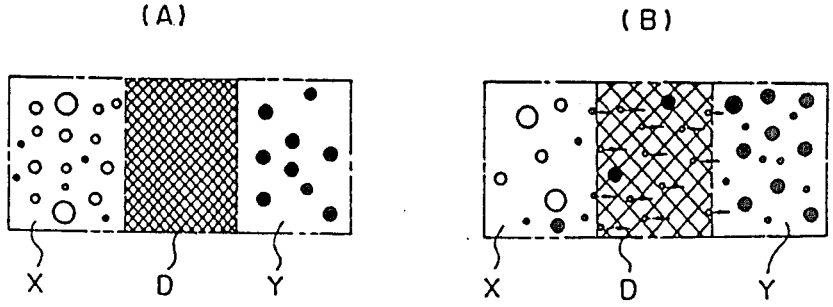

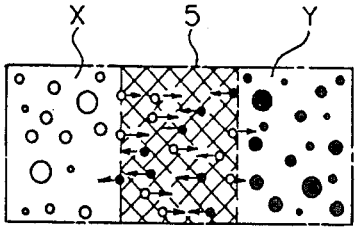
FIG. 5.
FIG. 6.
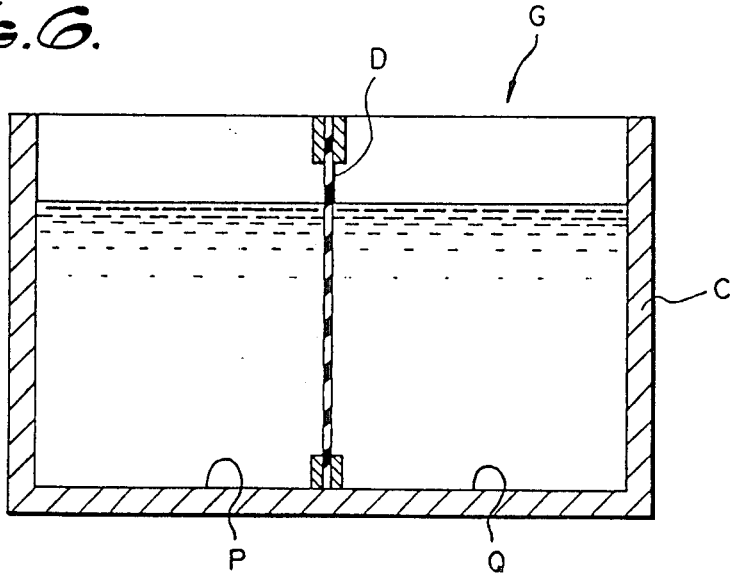

SEALED-TYPE HYDRAULIC LASH ADJUSTER

BACKGROUND OF THE INVENTION

The field of the present invention is lash adjusters for valve trains on internal combustion engines.

Generally, lash adjusters have been known for zero-adjusting a gap or clearance, such as a gap between a valve and a cam in a valve train of an internal combustion engine. A known example of such a lash adjuster is the so-called sealed-type hydraulic lash adjuster which comprises a tubular body having one end thereof closed by an end wall. A plunger slidably fitted into the body cooperates with the inner surface of the end wall of the body to form a high pressure chamber containing a hydraulic oil. A plunger spring is interposed between the plunger and the body to resiliently urge the plunger out of the body. A flexible diaphragm is mounted between the open end of the body and the plunger to define an annular storage chamber for the hydraulic oil to be supplied to the high pressure chamber. A check valve is provided in the high pressure chamber to prevent the hydraulic oil flowing from the high pressure chamber to the storage chamber.

In use, the sealed-type hydraulic lash adjuster may be mounted to a rocking center of a rocker arm disposed between a cam and a valve. If a clearance develops between the rocker arm and the valve cam, the plunger is projected from the body by the plunger spring, causing the rocker arm to be moved toward the valve and cam, thereby removing the clearance. In addition, as the body and the plunger are moved in relation to each other, the hydraulic or working oil is supplied from the storage chamber to the high pressure chamber, through the check valve. The hydraulic oil transferred into the high pressure chamber is sealed therein by the check valve to prevent the plunger from being retracted into the body, so that any clearances in the valve train assembly, which may develop due to thermal expansion or wear, are continuously compensated for and removed. Moreover, the change in volume of the storage chamber due to the out flow of the hydraulic oil is compensated for by the flexibility of the diaphragm.

However, when a hydraulic lash adjuster (HLA) is used over a long period of time, the amount of hydraulic oil in the reservoir chamber can change due to migration of hydraulic oil from the adjuster or migration of lubricant to the adjuster from the engine. A decrease in the amount of hydraulic oil in the reservoir chamber will not significantly affect the operation of the HLA. On the other hand, an increase in the amount of hydraulic oil in the storage chamber increases the pressure in the chamber, and adversely affects the operation of the plunger.

SUMMARY OF THE INVENTION

The present invention is directed to a hydraulic lash adjuster which substantially maintains a constant amount of hydraulic oil in the reservoir chamber, by providing a hydraulic oil in the storage chamber which has a molecular weight distribution which is substantially equal to or slightly lower than the molecular weight distribution of the oil in the region outside of the adjuster, that is, the oil in the apparatus in which the adjuster is used.

Accordingly, it is an object of the present invention to provide a hydraulic lash adjuster, which generally maintains a constant amount of hydraulic oil in the adjuster, thereby ensuring reliable operation of the adjuster, even over long periods of time. Other and further objects and advantages will appear hereinafter.

BRIEF DESCRIPTION OF THE DRAWINGS

In the drawings, wherein similar reference characters denote similar elements throughout the several views:

FIG. 1 is a graphical representation of measurements of the respective molecular weight distributions of a hydraulic oil and an exterior or lubricating oil, in the prior art sealed-type hydraulic lash adjuster;

FIGS. 2(A) and (B) are diagrammatic illustrations of the permeating or migrating mechanism of oil through a diaphragm;

FIG. 5 is a diagrammatic view illustrating the migrating mechanism of oil in the adjuster of the present invention; and FIG. 6 is a schematically illustrated sectional view of an instrument for experimentally selecting hydraulic and exterior oils.

DETAILED DESCRIPTION OF THE PREFERRED EMBODIMENT

Figure 3:
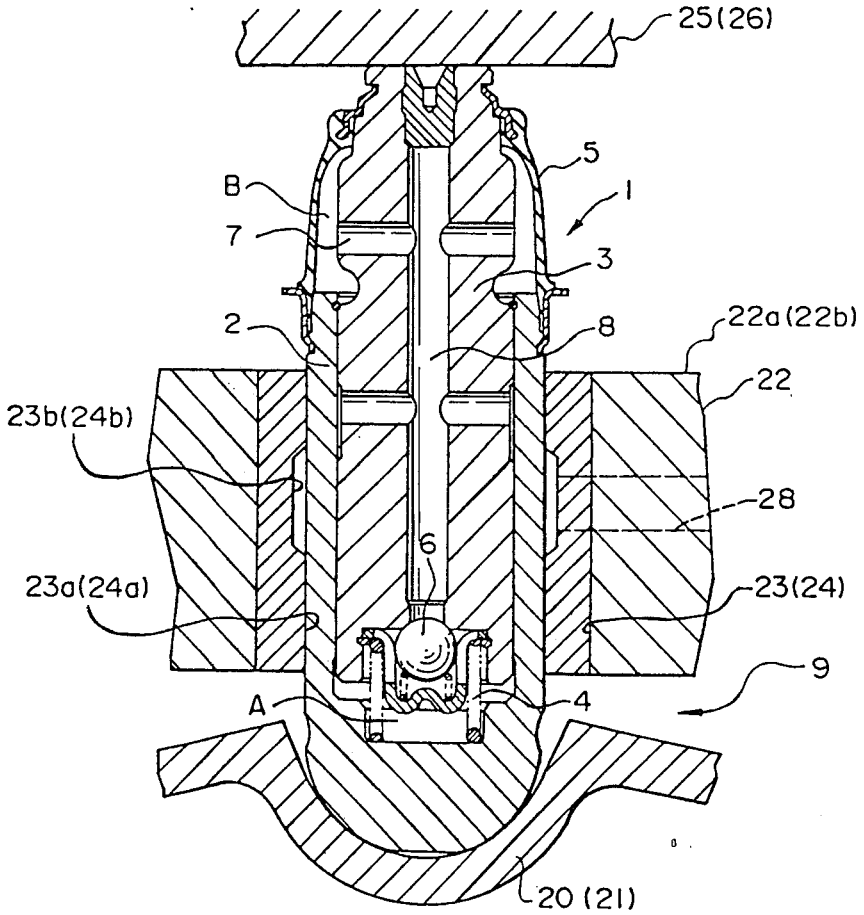
FIG. 3 is a fragmentarily illustrated lateral view, in part section, of the adjuster of the invention.

Turning in detail to the drawings, FIG. 1 graphically illustrates the results of gas chromatography measurements of the respective molecular weight distribution of the working or hydraulic oil within the storage chamber, and the exterior oil in contact with the outer surface of the diaphragm, before and after the operation of the adjuster. As shown in FIG. 1, with the hydraulic oil X, the distribution on the low molecular weight side was reduced after operation of the adjuster, as compared to the distribution before operation. In contrast, in the exterior oil Y, the distribution on the low molecular weight side was increased after operation.

In view of these experimental results, it has become apparent that the change in the amount of hydraulic oil in the storage chamber occurs through migration of oil deposited on the surfaces of the diaphragm, through the diaphragm. The diaphragm repeatedly expands and contracts at a high rate during operation of the adjuster. Accordingly, the diaphragm is provided with a relatively small wall thickness in order to resist flexing fatigue. As the hydraulic oil X and the exterior oil Y have different molecular weight distributions, when they are brought into contact with the inner and outer surfaces of the diaphragm, respectively, the diaphragm acts as a semi-permeable membrane, with respect to the low molecular weight compositions. An osmotic pressure develops across the diaphragm, and the low molecular compositions migrate through the diaphragm.

As shown in FIG. 2A, under the normal temperature conditions prior to operation, the intermolecular distance of the composition of the diaphragm D is small, and the migrating phenomenon of the low molecular weight composition of both the hydraulic oil X and the exterior oil Y is restrained. However, at high temperatures, such as those associated with operation of the adjuster within an internal combustion engine, the temperature of the diaphragm rises and the intermolecular bonding of the diaphragm material is loosened, with the intermolecular distance in the diaphragm becoming enlarged, as shown in FIG. 2B. This loosening of the material structure and increase in intermolecular distance promotes the migration activity of the low molecular weight oil composition. As as result, the low molecular weight composition of the hydraulic oil migrates into the exterior oil through the diaphragm D, so that the volume of hydraulic oil in the storage chamber is reduced. On the other hand, if the distribution of the low molecular weight composition of the exterior oil is greater than that of the hydraulic oil, the low molecular weight composition in the exterior oil will pass through the diaphragm into the hydraulic oil, so that the volume in the storage chamber increases.

In use, e.g., as installed in the valve train of an internal combustion engine, the outside of the diaphragm comes into direct contact with a mist or spray of an exterior oil, e.g., with the lubricating engine oil. In order to maintain the volume of hydraulic oil in the storage chamber, notwithstanding the migration or permeation effect, the diaphragm is formed of a flexible material, and the hydraulic oil is selected to have a molecular weight distribution approximately equal to that of the exterior oil outside of the lash adjuster. The hydraulic oil may also have a molecular weight distribution which is slightly lower than the molecular weight distribution of the external oil. Preferably, the diaphragm is formed of nitrile rubber or silicone rubber fluoride.

With this type of construction, in the hydraulic lash adjuster of the invention, the amount of hydraulic oil migrating from the interior to the exterior of the diaphragm substantially equals the amount of exterior oil passing from the exterior to the interior of the diaphragm, even if the intermolecular bonding of the diaphragm material is loosened. As a result, any change in volume within the storage chamber is effectively prevented.

A preferred embodiment of the lash adjuster of the present invention is shown in FIG. 3, wherein lash adjuster 1 includes a tubular body 2 to having one end thereof closed by an end wall. A plunger 3 is slidably disposed within body 2 and cooperates with the inner surface of the end wall of body 2 to define therebetween a high pressure chamber A containing a working or hydraulic oil X. A compression or plunger spring 4 is interposed between plunger 3 and body 2, to resiliently urge plunger 3 outwardly from body 2. A flexible diaphragm 5 is mounted between the opposite open end of body 2 and plunger 3 to form a storage chamber B for holding the hydraulic oil X to be supplied to high pressure chamber A. A check valve 6, for example, a ball check valve, is provided in high pressure A to prevent hydraulic oil X from flowing from high pressure chamber A into storage chamber B.

Plunger 3 includes passageways 7 and 8 for connecting storage chamber B and high pressure chamber A to each other. As previously described, hydraulic oil X has a molecular weight distribution substantially equal to that of the exterior oil, e.g., engine oil Y, which comes into contact with the exterior of diaphragm 5, which may be made of nitrile rubber (NBR), including hydrogenated nitrile rubber (HNBR).

Figure 4:
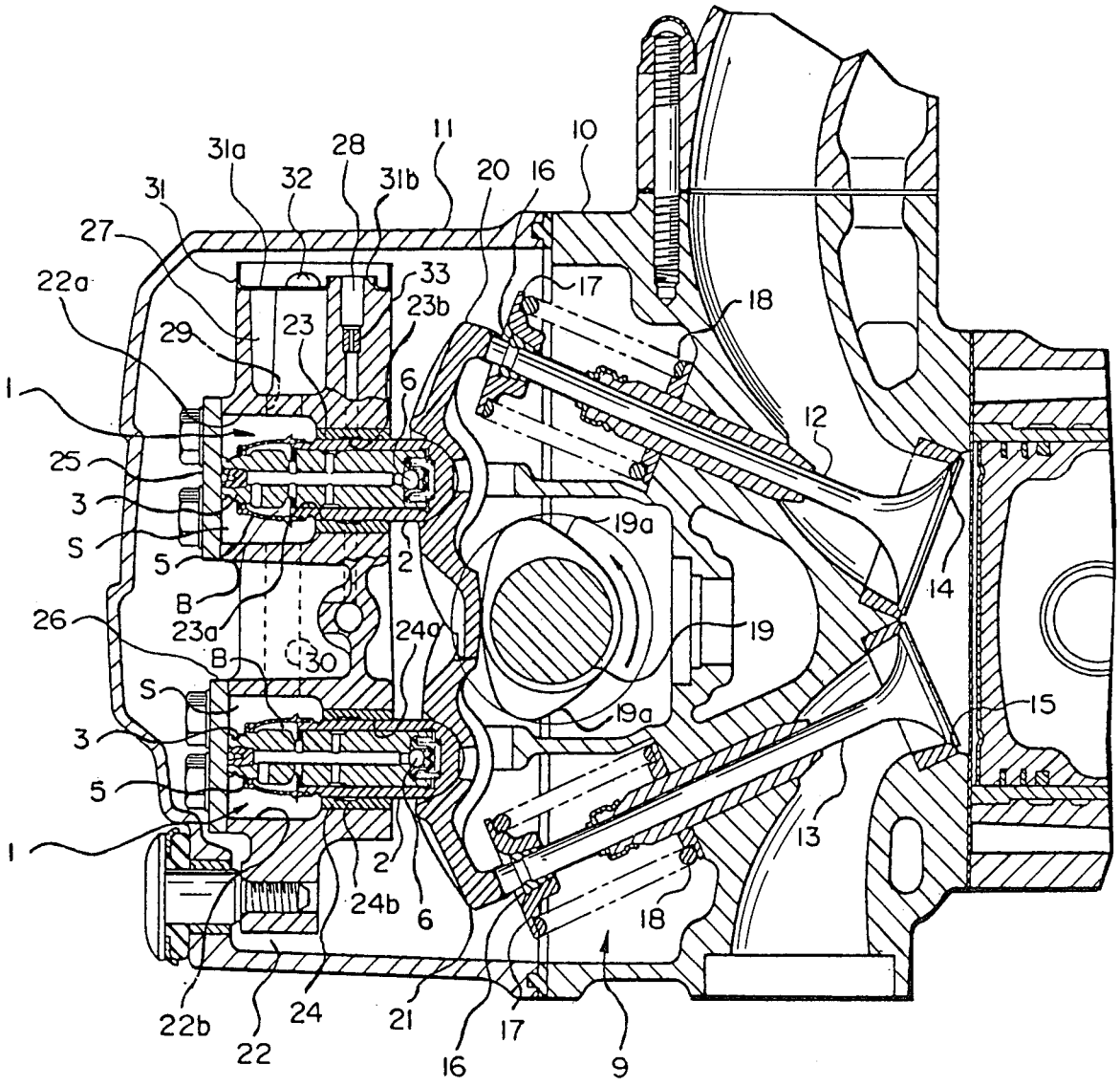
FIG. 4 is a fragmentarily illustrated front sectional view of the adjuster of the invention installed into an internal combustion engine.

The sealed-type hydraulic lash adjuster of the invention may be included in a valve train of an internal combustion engine, as illustrated in FIG. 4, wherein a valve train 9 is disposed within a space defined by a cylinder head 10 having a head cover 11 mounted thereon. An intake valve 12 and an exhaust valve 13 are slidably mounted in cylinder head 10 and slide in their respective longitudinal directions to respectively open and close a suction port 14, and an exhaust port 15, formed in cylinder head 10. Intake valve 12 and exhaust valve 13 have ends which project into the space between cylinder head 10 and head cover 11, and retainers 17 are mounted to the ends of valves 12 and 13 projecting into this space, via a wedging action of split cotters 16. Intake and exhaust valves 12 and 13 are normally biased toward their respective closed positions by valve springs 18 disposed between retainers 17 and cylinder head 10. The valves are moved to their respective open positions against the resilient forces exerted by valve springs 18.

Valve train 9 includes a camshaft 19 rotatably mounted on cylinder head 10 in between valves 12 and 13. A plurality of cams **19*a* are mounted on, and rotate with, camshaft 19. Pivotable rocker arms 20 and 21 are disposed between camshaft 19 and the projecting end of valves 12 and 13, respectively. A holder 22, which may be formed of an aluminum alloy, is mounted to cylinder head 10 opposed to, but spaced apart from, rocker arms 20 and 21. The sealed-type hydraulic lash adjusters of the present invention are slidably supported in holder 22 such that a rocking or pivoting central portion of each rocker arm 20, 21 is fitted onto a corresponding end of one of the adjusters 1**, to provide a rocking movement relative thereto.

Steel bushings 23 and 24 extend parallel to the axis of lash adjusters 1 and are attached to holder 22 by e.g., a forcefit. Lash adjusters 1 are fitted through guide bores **23*a* and 24*a* passing through bushings 23 and 24, respectively. Recesses 22*a* and 22*b* are formed opposite to rocker arms 20 and 21 and are continuous with guide bores 23*a* and 24*a*, respectively. Recesses 22*a* and 22*b* are respectively closed by closures 25 and 26**, to define closed spaces S.

Holder 22 has an upper portion including an oil reservoir 27 and an oil supply passage 28 which open upwardly, and which extend substantially vertically, i.e., in a direction perpendicular to the longitudinal axis of lash adjusters 1. Oil reservoir 27 is connected with recesses **22*a* and 22*b* through passageways 29 and 30 formed in holder 22. Oil supply passage 28 is joined with peripheral grooves 23*b* and 24*b* which are formed in the inner peripheral surfaces of bushings 23 and 24, respectively. Therefore, engine oil Y scattered by camshaft 19 and other moving components is supplied to closed space S and to the inner peripheral surfaces of bushing 23 to 24 which serve as sliding surfaces and are brought into sliding contact with lash adjusters 1**.

An oil receiving pan 31 is attached to the upper portion of holder 22 with bolts 32 to close the opening of oil reservoir 27. Oil receiving pan 31 is provided with bores **31*a* and 31*b* which are aligned and continuous with reservoir 27 and oil supply passage 28, respectively, so that pan 31 receives engine oil Y and introduces it into oil reservoir 27 and oil supply passage 28. An orifice 33 is provided in oil supply passage 28 for regulating the amount of engine oil Y supplied to the inner peripheral surfaces of bushings 23 and 24**.

Each of lash adjusters 1 is supported by holder 22 in a manner such that body 2 of each adjuster is slidably fitted into the corresponding guide bore **23*a*, 24*a*. The projecting end of plunger 3 and diaphragm 5 which define storage chamber B are located in corresponding recesses 22*a* and 22*b*, wherein they are immersed in engine oil Y. The projecting end of plunger 3 abuts against the corresponding closure 25, 26. The end wall of body 2 of each adjuster has a spherical outer surface which is fitted into the rocking center of rocker arm 20, 21**, to support the rocker arms and allow for their rocking or pivoting movement.

The following example is given by way of illustration, and not by way of limitation.

EXAMPLE

The lash adjusters of the invention were mounted into the valve train 9, as described above. The engine in which the lash adjusters were installed was started and continuously operated for 200 hours in an ambient temperature of approximately 140°±5° C. The engine rotational speed was 4,000–7,000 rpm. After this period of operation, there was substantially no change in the volume of each storage chamber B.

The absence of change in volume of each storage chamber B can apparently be attributed to the fact that, as described above, the working or hydraulic oil X and the engine oil Y are made substantially equal in molecular weight distribution. Therefore, even if the intermolecular bonding of diaphragm 5 is loosened under high temperature, the amount of hydraulic oil X migrating from the interior to the exterior of storage chamber B through diaphragm 5 would be substantially equal to the amount of engine oil Y migrating from the exterior to the interior of storage chamber B, as graphically illustrated in FIG. 5.

Accordingly, in the lash adjuster of the invention, even if diaphragm 5 is formed of a material having an oil porosity or permeability under high temperature, the volume of storage chamber B will remain constant, and the desired operating characteristics of the lash adjuster will be substantially ensured. Therefore, even if diaphragm 5 is made of an inexpensive material, such as nitrile rubber or the like, the lash adjuster is capable of reliable operation, even over a long period of time.

If it is difficult to determine the molecular weight distribution of the hydraulic oil and the exterior or engine oil by the use of gas chromatography, it is possible to select the oils by the use of an experimental instrument. As shown in FIG. 6, such an instrument G is constructed by dividing the interior of a rectangular parallepiped vessel C by a membrane D made of a material identical to that of the diaphragm of the lash adjuster.

To determine relative molecular weight distributions of oils, one of the two divided compartments P and Q is filled with e.g., engine oil, and the other compartment is filled with the hydraulic or working oil to be tested, until the oils reach the same level within the compartments. The entire experimental instrument G is then placed in a high temperature chamber for a long period of time. This experimental technique is conducted for combinations of various kinds of hydraulic and exterior or engine oils, and the combinations of oils which do not show any change in level between the two compartments are selected for use.

Of course, if the engine oil used is known, the same oil may be used as the hydraulic oil, thereby avoiding the necessity of such a selecting operation. In addition, various modifications may be made to suit a particular application. For example, a hydraulic oil may be used which has a molecular weight distribution slightly deviated toward the side of a low molecular weight from the molecular weight distribution of the exterior oil. By using such a hydraulic oil, it is possible to utilize more types of hydraulic oils and exterior oils. It is also possible to limit the migration direction of the oil composition to the direction from storage chamber B toward the exterior thereof, thereby limiting any change in volume of storage chamber B to a reduction in volume, i.e., to a change which has little influence on the operating characteristics of the HLA. In addition, diaphragm 5 may be formed of silicone rubber fluoride which has improved flexibility and elasticity, and also allows the operating characteristics of the adjuster to be maintained over a wider temperature range and also providing for reliable operation over a long period of time.

Thus, a sealed-type hydraulic lash adjuster is disclosed which has a hydraulic oil in a reservoir chamber having a molecular weight distribution substantially equal to or slightly deviated toward a lower side of the molecular weight from the molecular weight distribution of the exterior oil outside of the lash adjuster. While embodiments and applications of this invention have been shown and described, it would be apparent to those skilled in the art that many more modifications are possible without departing from the event and concepts herein. The invention, therefore, is not to be restricted except in the spirit of the appended claims.

What is claimed is:

1. A sealed-type hydraulic lash adjuster for use in an apparatus wherein the lash adjuster comes into contact with a lubricating oil, comprising:

a reservoir chamber containing a hydraulic working oil and generally sealed by an elastomeric diaphragm in direct contact with the lubricating oil, wherein said hydraulic working oil has a molecular weight distribution which is substantially equal to that of said lubricating oil.

2. The lash adjuster of claim 1 further comprising:

a tubular body having an open end, and a closed end including a closed end wall having an inner surface;

a plunger slidably fitted into said body and cooperating with said inner surface of said end wall of said body to define therebetween a high pressure chamber containing said hydraulic working oil; and said diaphragm being disposed at the open end of said body and cooperating with said plunger to form said reservoir chamber for storing hydraulic working oil to be supplied to said high pressure chamber.

3. The lash adjuster of claim 1 wherein said diaphragm is made of rubber.

4. The lash adjuster of claim 3 wherein said rubber is nitrile rubber.

5. The lash adjuster of claim 3 wherein said rubber is silicone rubber fluoride.

6. The sealed-type hydraulic lash adjuster for use in an apparatus wherein the lash adjuster comes into contact with a lubricating oil, comprising:

a reservoir chamber containing a hydraulic working oil and generally sealed by an elastomeric diaphragm in direct contact with the lubricating oil, wherein said hydraulic working oil has a molecular weight distribution slightly lower than the molecular weight distribution of the lubricating oil.

* * * * *